US007026031B2

(12) United States Patent
Holeschovsky et al.

(10) Patent No.: US 7,026,031 B2
(45) Date of Patent: Apr. 11, 2006

(54) TUFT BIND OF URETHANE BACKED ARTIFICIAL TURF

(75) Inventors: Ulrich B. Holeschovsky, Mt Lebanon, PA (US); Jeffrey L. Robbins, Chattanooga, TN (US); Harry Stefanou, Strafford, PA (US)

(73) Assignee: Bayer MaterialScience LLC, Pittsburgh, PA (US)

( * ) Notice: Subject to any disclaimer, the term of this patent is extended or adjusted under 35 U.S.C. 154(b) by 234 days.

(21) Appl. No.: 10/310,375

(22) Filed: Dec. 5, 2002

(65) Prior Publication Data

US 2004/0109976 A1 Jun. 10, 2004

(51) Int. Cl.

| | |
|---|---|
| ***B32B 33/00*** | (2006.01) |
| ***D05C 17/02*** | (2006.01) |
| ***D05C 15/04*** | (2006.01) |
| ***H05H 1/00*** | (2006.01) |

(52) U.S. Cl. ..... 428/97; 428/95; 428/96; 156/72; 156/272.6; 427/535; 427/569

(58) Field of Classification Search ..... 428/97, 428/95, 88, 89, 92, 96; 156/272.6, 72, 272.2, 156/273.3; 427/533, 535, 536, 569
See application file for complete search history.

(56) References Cited

U.S. PATENT DOCUMENTS

| | | | | |
|---|---|---|---|---|
| 3,962,386 | A | 6/1976 | Driscoll | 264/22 |
| 4,178,272 | A * | 12/1979 | Meyer et al. | 525/210 |
| 4,401,708 | A | 8/1983 | Paul | 428/198 |
| 4,617,208 | A * | 10/1986 | Cadenhead, Sr. | 428/17 |
| 5,221,394 | A | 6/1993 | Epple et al. | 156/230 |
| 5,445,860 | A | 8/1995 | Bova | 428/87 |
| 5,612,113 | A | 3/1997 | Irwin, Sr. | 428/95 |
| 5,714,224 | A | 2/1998 | Gerry | 428/95 |
| 5,922,202 | A * | 7/1999 | Elgas et al. | 210/456 |
| 6,171,678 | B1 | 1/2001 | Holeschovsky et al. | 428/97 |
| 2003/0134081 | A1 * | 7/2003 | Holeschovsky et al. | 428/95 |

FOREIGN PATENT DOCUMENTS

| | | | |
|---|---|---|---|
| JP | 57-101078 | A * | 6/1982 |
| JP | 04-039135 | A * | 2/1992 |
| JP | 08-323930 | A * | 12/1996 |

OTHER PUBLICATIONS

English translation of JP 57-101078.*

* cited by examiner

*Primary Examiner*—Cheryl A. Juska
(74) *Attorney, Agent, or Firm*—Joseph C. Gil; Lyndanne M. Whalen; N. Denise Brown

(57) ABSTRACT

The present invention relates to an improved process for the production of artificial turf, and the improved artificial turf. In accordance with this process, fibers are treated via corona discharge, tufted into a primary backing to form a greige good, and a precoat is applied to the back surface the greige good. Suitable fibers are polyolefins, and suitable precoats are reactive polyurethane mixtures. The fibers may be treated by corona discharge either before they are tufted into the primary backing to form the greige good or after the are tufted into the primary backing. Artifical turfs of the present invention comprise a greige good having fibers tufted into a primary backing, with the fibers being treated by corona discharge either before or after being tufted into the primary backing, and a precoat which is attached by its face surface to the back surface of the greige good.

14 Claims, No Drawings

TUFT BIND OF URETHANE BACKED ARTIFICIAL TURF

BACKGROUND OF THE INVENTION

The present invention relates to a process for the production of artificial turf and to improved artificial turf. The process comprises tufting fibers into a primary backing to form a greige good, wherein the fibers are treated via corona discharge either before or after the tufting step, and applying a precoat to the back surface of the greige good wherein the precoat comprises a reactive polyurethane mixture. The artificial turfs of the present invention comprise a greige good having fibers tufted into a primary backing, and a precoat wherein the face surface of the precoat is adhered to the back surface of the greige good and the precoat comprises a polyurethane forming composition. The fibers tufted into the primary backing in this embodiment of the invention are treated via corona discharge either before the tufting step or after the tufting step.

Tufted goods, including carpeting and artificial turf, are manufactured by tufting yarns into a primary backing. The tufts are secured by applying at least one adhesive formulation to the primary backing side of the carpet/primary backing ("greige good"). Polyurethanes have largely replaced SBR latex as the backing material of choice for demanding outdoor applications such as athletic turf due to the inherent resistance of polyurethane against water degradation and generally superior durability. Nylon with its polar characteristics bonds quite well with precoats made with polyurethanes.

Recently, there has been a trend in the industry to move towards using polyolefin fibers or tape, such as polyethylene, because these materials are considerably less abrasive than nylon, and thus reduce the incidence of skin scraping injuries. These polyolefins are non-polar and thus bonding to polyurethane precoats is somewhat diminished resulting in lower tuftbinds compared to that of nylon turf.

Tufted carpet and a process for preparing the tufted carpet is described in U.S. Pat. No. 5,714,224. The tufted carpet of the '224 patent comprises a moisture barrier layer. More specifically, this carpet comprises a primary backing stitched with loops of yarn to form a tufted structure projecting outwardly from the primary backing, a layer of latex affixed to the primary backing, a layer of polyolefin affixed to the layer of latex, and a secondary backing comprising a woven polyolefin, which is affixed to the layer of polyolefin. The process described therein comprising providing a primary backing stitched with loops of yarn to form a tufted structure projecting outwardly from the primary backing, providing a secondary backing comprising a woven polyolefin, applying a layer of polyolefin onto the secondary backing, interposing a layer of latex between the primary backing and the polyolefin layer, and laminating the primary backing, the latex layer, the polyolefin layer, and secondary backing layer together.

Carpets having fluid barriers are described in U.S. Pat. No. 5,612,113. These carpets have a primary backing into which tufted yarn is stitched, a secondary backing to provide dimensional stability, and a thin film of a material which is impervious to spills, with the film being bonded to either the primary backing or the secondary backing by an adhesive which is provides an adequate bond and is insoluble to spilled fluids. Suitable materials for the thin film include polyethylene, polypropylene, polyurethane, polyester, polyvinylchloride (PVC), combinations thereof and similar thermoplastic materials which may be surface treated, as well as composite structures formed from laminates of these fibers with non-woven or woven fibers and either with or without reinforcing fibers. Corona treatment of the film on one side is broadly disclosed as possibly being sufficient to render the film bondable to the backing.

Copending U.S. application Ser. No. 10/028,897 filed on Dec. 18, 2001 describes tufted goods (including carpets and artificial turf) which can be made without a secondary backing. In general, secondary backings have been necessary in carpets and in processes for producing carpets to provide dimensional stability. As described therein, corona-treatment of a flexible film which is contacted or laminated to a polyurethane precoated greige good or to a foam layer applied to a precoated greige good creates a bond that is strong enough to render the resultant cured carpeting article dimensionally stable, with no secondary backing. The delamination strength of these cured tufted goods exceeds that of conventional tufted goods. It is possible to include secondary backings in the tufted goods, but this generally only results in further increases the costs of the processes and the resultant products, without further improvements in properties.

U.S. Pat. No. 3,962,386 describes corona discharge treatment of foam fibrillated webs. These foam fibrillated fibrous webs are prepared by an extrusion process. The foam fibrillated fibrous webs may be treated via corona-discharge to provide improved internal adhesion of the webs when they are laminated to form a non-woven fabric. These webs do not have tufts, greige goods or precoats as required by the present invention.

Nonwoven fabrics and a method of bonding the nonwoven fabrics are disclosed in U.S. Pat. No. 4,401,708. The web of fibers can be treated with microwave energy and a polar solvent (column 1, line 60 through column 2, line 4). Pretreatment of the fibers with corona discharge is also disclosed as improving the adhesion between the fibers of the nonwoven fabrics. Tufted goods are not disclosed by the '708 patent.

U.S. Pat. No. 5,221,394 discloses a method for manufacturing backed, pressure-adherent industrial carpeting. This carpeting comprises a backing film and an adhesive on one side of the backing film. The other side of the backing film is heat laminated to a web of carpeting to reinforce the carpeting and provide it with an adhesive. Corona discharge of the backing film is disclosed, and heat lamination is used to bond the fibers and the backing. This reference discloses improved bonding between the corona treated backing and the release layer.

Tufted products having improved backing are disclosed in U.S. Pat. No. 5,445,860. These tufted products are made by, for example, tufting pile yarn fibers into a tufting backing which is composed of a primary backing, a secondary backing and an elastomer sandwiched between the primary and secondary backings. It is also possible for the tufting backing to be composed of only a primary backing and an elastomer adhered to the primary backing. Thus, the secondary backing is optional. When a secondary backing is present, the elastomer is sandwiched between the primary and secondary backing layers. The elastomer may be applied as a solid sheet of elastomer, or it may be melted and applied. The solid sheet of elastomer is heated at some point to allow the elastomer to flow in and around the pile yarn fibers. Once the elastomer layer is cooled, the pile yarn fibers are bonded to the tufting backing. It is further disclosed that the bonding of the elastomer to the primary backing may be improved by treating the primary backing with a corona discharge or gas flame. Bonding between the primary backing and the elastomer may also be improved by suctioning the elastomer to the primary backing with, for example, a vacuum.

U.S. Pat. No. 6,171,678 discloses carpeting which exhibits improved tuft bind and/or improved elongation. These improvements are due to a particular polyol formulation used in the reactive polyurethane adhesive. Corona discharge is not discussed in U.S. Pat. No. 6,171,678.

Advantages of the present invention include artificial turf materials exhibiting improved properties. More specifically, these exhibit improved tuft bind between non-polar polyolefin turf materials and polyurethane precoats used to back the artificial turf.

SUMMARY OF THE INVENTION

This invention relates to a process for the production of artificial turf and to an improved artificial turf, wherein the fibers which are tufted into the primary backing forming the greige good are treated via corona-discharge at a rate of 0.2 to 20 Ws/cm$^2$.

In one embodiment of the present invention, the process for the production of artificial turf comprises:

(A) treating fibers via corona-discharge at a rate of 0.2 to 20 Ws/cm$^2$, wherein the fibers comprise a polyolefin;

(B) tufting the treated fibers into a primary backing to form a greige good, and (C) applying a precoat to the back surface of the greige good, wherein the precoat comprises a reactive polyurethane mixture.

Another embodiment of the process for the production of artificial turf comprises:

(A) tufting fibers into a primary backing to form a greige good, wherein the fibers comprise a polyolefin;

(B) treating the fibers of the greige good via corona-discharge at a rate of 0.2 to 20 Ws/cm$^2$; and (C) applying a precoat to the back surface of the greige good wherein the precoat comprises a reactive polyurethane mixture.

Another aspect of the present invention is directed to artificial turf wherein the fibers which are tufted into the primary backing forming the greige good are treated via corona discharge at the specified rate of 0.2 to 20 Ws/cm$^2$. The artificial turf of the present invention comprises:

(1) a greige good comprising one or more fibers tufted into a primary backing, wherein the greige good has a face surface and a back surface, and the fibers of the greige good are treated via corona-discharge at a rate of 0.2 to 20 Ws/cm$^2$, and the fibers comprise a polyolefin; and (2) a precoat having a face surface and a back surface, wherein the face surface of the precoat is adhered to the back surface of the greige good and the precoat comprises a polyurethane forming composition.

In the artificial turf of the present invention, the fibers may either be treated via corona discharge before being tufted into the primary backing to form the greige good, or after the fibers are tufted into the primary backing to form said greige good.

DETAILED DESCRIPTION OF THE INVENTION

As used herein, the term fibers refers to fibers, yarns, tufts, monofilaments, ribbons, or precursors thereof such as, for example, films and/or tapes.

Suitable fibers to be used in the present invention include, for example, fibers, yarns, films and ribbons which are spun, fibrillated, slit, split and/or serrated. Preferred fibers to be used in the presently claimed invention include ribbons made of polyethylene and polypropylene. This type of fiber may be fibrillated by using brushes after installation of the field. This brushing action serrates the ribbon into finer textured turf. These ribbons are often twisted before being wound onto the skanes to produce a more grass like appearance.

Suitable primary backings for the process and artificial turf of the present invention include both woven and non-woven primary backings. More specifically, suitable backings include those prepared from jute, polypropylene, polyethylene, etc., as well as any other material known to be suitable for primary backings in either carpeting or artificial turf. It is preferred that the primary backings comprise polypropylene.

The process of producing the artificial turf or carpets of the present invention is similar to the conventional process in that fibers or yarns are tufted into a primary woven backing of jute, polypropylene or the like to form a greige good; and the primary backing side of the greige good is contacted with a reactive polyurethane, which may be mechanically frothed. The process of the present invention differs from conventional processes for producing artificial turf in that the fibers or yarns are treated via corona-discharge at a rate of 0.2 to 20 Ws/cm$^2$, preferably of 0.4 to 10 Ws/cm$^2$. The treatment via corona-discharge of the fibers or yarns may occur either prior to the fibers or yarns being tufted into the primary backing, or after the fibers or yarns are tufted into the primary backing to form the greige good.

The polyurethane may be applied by conventional methods, including dipping, spraying, etc. The frothing of the reactive mixture may be accomplished by using a frothing apparatus, for example an Oakes or Firestone froth head. The thickness of the reactive mixtures may be gauged by a doctor blade, roller, air blade, etc., all well known to the art.

The reactive polyurethane systems comprise one or more di- or polyisocyanates (i.e. an A-side), and an isocyanate-reactive component (i.e. a B-side) which comprises one or more polyols, generally polyols having nominal functionalities of from 2 to 8, one or more low molecular weight chain extenders, one or more polyurethane-promoting catalysts, and optionally components including suitable surfactants, crosslinkers, plasticizers, pigments, and other well known polyurethane additives. In general, a filler is also employed. Preferred reactive polyurethane systems to be used in the present invention are described in detail in, for example, U.S. Pat. Nos. 5,462,766, 5,558,917, 5,723,194, 6,171,678 and 6,265,775, the disclosures of which are herein incorporated by reference.

Frothing of the formulations described above can be accomplished as described in, for example, U.S. Pat. No. 5,604,267, the disclosure of which is herein incorporated by reference. Frothing may also be accomplished in the conventional manner by introducing the reactive ingredients together with a substantially inert gas such as air, nitrogen, argon, carbon dioxide, or the like, into a froth mixer such as an Oakes or Firestone mixer. The frothed mixtures are generally gauged with a doctor blade or roller, or the like, to the desired thickness. Frothed mixtures may also include a volatile or reactive blowing agent in addition to being mechanically frothed, to produce a precoat with a relatively low density.

Blowing agents in blown and froth/blown foams may be selected from those conventionally used, including fluorochlorocarbons, in particular R-22 (dichlorodifluoromethane), but are more preferably low boiling hydrocarbons, ketones, ethers, carbonates, or the like, and most preferably is water, either alone or in conjunction with another blowing agent. Solid blowing agents may also be useful but are not preferred.

The precoats of reactive polyurethane in the present invention are typically cured by exposure to temperatures ranging from about 60 to about 150° C. for times ranging from about 2 to about 8 minutes. It is preferred that these are cured at temperatures of about 100° C. for about 4 minutes.

The following examples further illustrate details for the process of this invention. The invention, which is set forth in the foregoing disclosure, is not to be limited either in spirit or scope by these examples. Those skilled in the art will readily understand that known variations of the conditions of the following procedures can be used. Unless otherwise noted, all temperatures are degrees Celsius and all parts and percentages are parts by weight and percentages by weight, respectively.

The invention is further illustrated but is not intended to be limited by the following examples in which all parts and percentages are by weight unless otherwise specified.

EXAMPLES

The following components were used to form the precoat formulation for the working examples.

| | |
|---|---|
| Atlantis ® Q-1000: | an isocyanate-reactive blend having an OH number of about 118, and which is commercially available from Bayer Corp. |
| Isocyanate A: | a isocyanate prepolymer of diphenylmethane diisocyanate having an NCO group content of about 27.5% |
| DEG: | diethylene glycol |
| Urethane Catalyst: | a tin catalyst |

The following precoat formulation was used in the Examples as described below.

| Precoat Formulation: | Parts by Weight |
|---|---|
| Atlantis ® Q-1000 | 91 |
| DEG | 9 |
| Urethane Catalyst | 0.3 |
| $CaCO_3$ | 180 |
| Isocyanate A | 65 |

The first four (4) components of the above precoat formulation were blended in a "Kitchen Aide" wire whisk blender for 2 minutes. Then, Isocyanate A was added and blending continued for one (1) additional minute. Following the blending, the mixture was applied to the back of the greige good samples of the Examples below at an applied rate of about 20 oz/yd$^2$. The coated greige goods were then placed in an oven at 100° C. and cured for about 4 minutes. The tuft bind of the cured, coated greige good from the Examples was measured according to ASTM D 1335-67 (Reapproved, 1972), "Standard Test Method for Tuft Bind of Pile Floor Coverings". These results are reported below.

Comparative Example

Uncoated polyethylene turf was used as the greige good in this Example. The uncoated turf was coated with the above precoat formulation, in the manner as described above. After curing, the tuft bind was evaluated.

Example

Uncoated polyethylene turf was corona treated using a lab corona treater available from Tantec Inc, Schaumburg, Ill., model HV 202 using a 4" roller electrode. The precoat formulation described above was applied to the corona treated polyethylene turf before curing. Tuft bind of the sample was evaluated after curing.

| Example | Tuft Bind | Standard Deviation |
|---|---|---|
| Comparative Example | 9.3 lbs. | 1.1 lbs. (10 pulls) |
| Example | 12.8 lbs. | 1.7 lbs. (10 pulls) |

These results illustrate that the present invention results in an increase in tuft bind of about 38%.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. A process for the production of an artificial turf comprising (A) treating fibers via corona discharge at a rate of 0.2 to 20 Ws/cm$^2{}_1$ wherein said hbors comprise a polyolefin;

(B) tufting the treated fibers into a primary backing to form a greige good, and (C) applying a precoat to the back surface of the greige good, wherein said precoat comprises a reactive polyurethane mixture.

2. The process of claim 1, wherein said fibers comprise fibers selected from the group consisting of polyethylene ribbons and polypropylene ribbons.

3. The process of claim 1, wherein corona discharge rate ranges from 0.4 to 10 Ws/cm$^2$.

4. The process of claim 1, wherein the reactive polyurethane mixture is mechanically frothed.

5. The process of claim 4, wherein the reactive polyurethane mixture comprises one or more di- or polyisocyanates, and an isoeyanate-reactive component comprising one or more polyols, and one or more low molecular weight chain extenders, and one or more calalysts.

6. The process of claim 5, wherein the reactive polyurethane mixture additionally comprises one or more fillers.

7. The process of claim 5, wherein the reactive polyurethane mixture additionally comprises one or more blowing agents.

8. An artificial turf comprising:

(1) a greige good comprising one or more fibers tufted into a primary backing, said greige good having a face surface and a back surface, wherein said fibers of said greige good are treated via corona discharge at a rate of 0.2 to 20 Ws/cm$^2$ before being tufted into said primary backing to form said greige good and said fibers comprise a polyolefin; and (2) a precoat having a face surface and a back surface, wherein the face surface of said precoat is adhered to the back surface of said greige good and said precoat comprises a polyurethane forming composition.

9. The artificial turf of claim 8, wherein said fibers comprise fibers selected from the group consisting of polyethylene ribbons and polypropylene ribbons.

10. The artificial turf of claim 8, wherein corona discharge rate ranges from 0.4 to 10 $Ws/cm^2$.

11. The artificial turf of claim 8, wherein the reactive polyurethane mixture is mechanically frothed.

12. The artificial turf of claim 11, wherein the reactive polyurethane mixture comprises one or more di- or polyisocyanates, and an isocyanale-reactive component comprising one or more polyols, and one or more low molecular weight chain extenders, and one or more catalysts.

13. The artificial turf of claim 12, wherein the reactive polyurethane mixture additionally comprises one or more fillers.

14. The artificial turf of claim 12, wherein the reactive polyurethane mixture additionally comprises one or more blowing agents.

* * * * *